United States Patent [19]

Habich et al.

[11] Patent Number: 4,635,919

[45] Date of Patent: Jan. 13, 1987

[54] FLOATING DOCUMENT THROAT

[75] Inventors: Adolph B. Habich, Austin; Ronald E. Hunt, Georgetown, both of Tex.

[73] Assignee: International Business Machines Corporation, Armonk, N.Y.

[21] Appl. No.: 666,791

[22] Filed: Oct. 31, 1984

[51] Int. Cl.[4] ..... B65H 3/30

[52] U.S. Cl. ..... 271/22; 271/24; 271/124; 271/127; 271/170; 271/119

[58] Field of Search ..... 271/21, 22, 24, 25, 271/124, 127, 170, 167, 119

[56] References Cited

U.S. PATENT DOCUMENTS

| | | | |
|---|---|---|---|
| 3,601,389 | 8/1971 | Kramer | 271/170 |
| 3,966,190 | 6/1976 | Grant | 271/119 X |
| 4,253,652 | 3/1981 | Steinhilber | 271/22 X |

FOREIGN PATENT DOCUMENTS

| | | | |
|---|---|---|---|
| 31830 | 2/1983 | Japan | 271/167 |

OTHER PUBLICATIONS

IBM Technical Disclosure Bulletin, vol. 24, No. 10, pp. 5028–5030, "Paper Feed System", L. Adams Jr.

*IBM Technical Disclosure Bulletin,* "Transverse Corner Restraint Sheetfeed", to Sobey, vol. 25, No. 8, Jan. 1983, pp. 4212–4213.

*IBM Technical Disclosure Bulletin,* "Multiple Path Card Feeding Device", to Robbins, vol. 11, No. 1, Jun. 1968, pp. 33–34.

*Primary Examiner*—Richard A. Schacher

*Attorney, Agent, or Firm*—Marilyn D. Smith; Andrea P. Bryant

[57] ABSTRACT

There is disclosed an envelope hopper for attachment to a printer requiring envelopes. Spring members provided with adjustable throats for permitting passage of a single envelope are biased downward against the upward force of the supply stack for compensating for changes in relative position of the uppermost envelope and the throats during separation from the stack.

3 Claims, 4 Drawing Figures

FLOATING DOCUMENT THROAT

TECHNICAL FIELD

This invention relates to document feeding. More specifically it relates to top feeding of envelopes to a using device from a stack upwardly biased against a downwardly biased stop means adjusted to a width through which only a single document will pass.

BACKGROUND ART

U.S. Pat. No. 3,966,190 to Grant discloses top feeding from an upwardly biased stack of documents through a throat structured to accommodate a single document's passage therethrough. A composite D roller is used to separate the topmost sheet and urge it through the throat opening. The structural members forming the throat, however, are in fixed position for a document feeding sequence.

Commonly assigned U.S. patent application Ser. No. 617,763 to Parks et al filed June 6, 1984, discloses a dual compartment cut sheet hopper for attachment to a printer or the like and includes movable corner buckler edge restraints adapted to maintain contact with the uppermost sheet in the hopper during a feed cycle.

DISCLOSURE OF THE INVENTION

The present invention provides a throat structure which is adjustable in width to accommodate a variety of document thicknesses but is additionally biased downwardly in a direction opposite that in which the document stack is biased so that as the separator rollers contact the stack and push it downwardly from the throat, the throat members are able to float down with the document stack and maintain alignment with the topmost document to avoid misfeeds and document crumpling.

BRIEF DESCRIPTION OF THE DRAWING

A better understanding of the invention may be had from the following more detailed description taken in conjunction with the accompanying drawing wherein like reference numerals are used throughout the views to denote the same components.

BEST MODE FOR CARRYING OUT THE INVENTION

Figure 1:
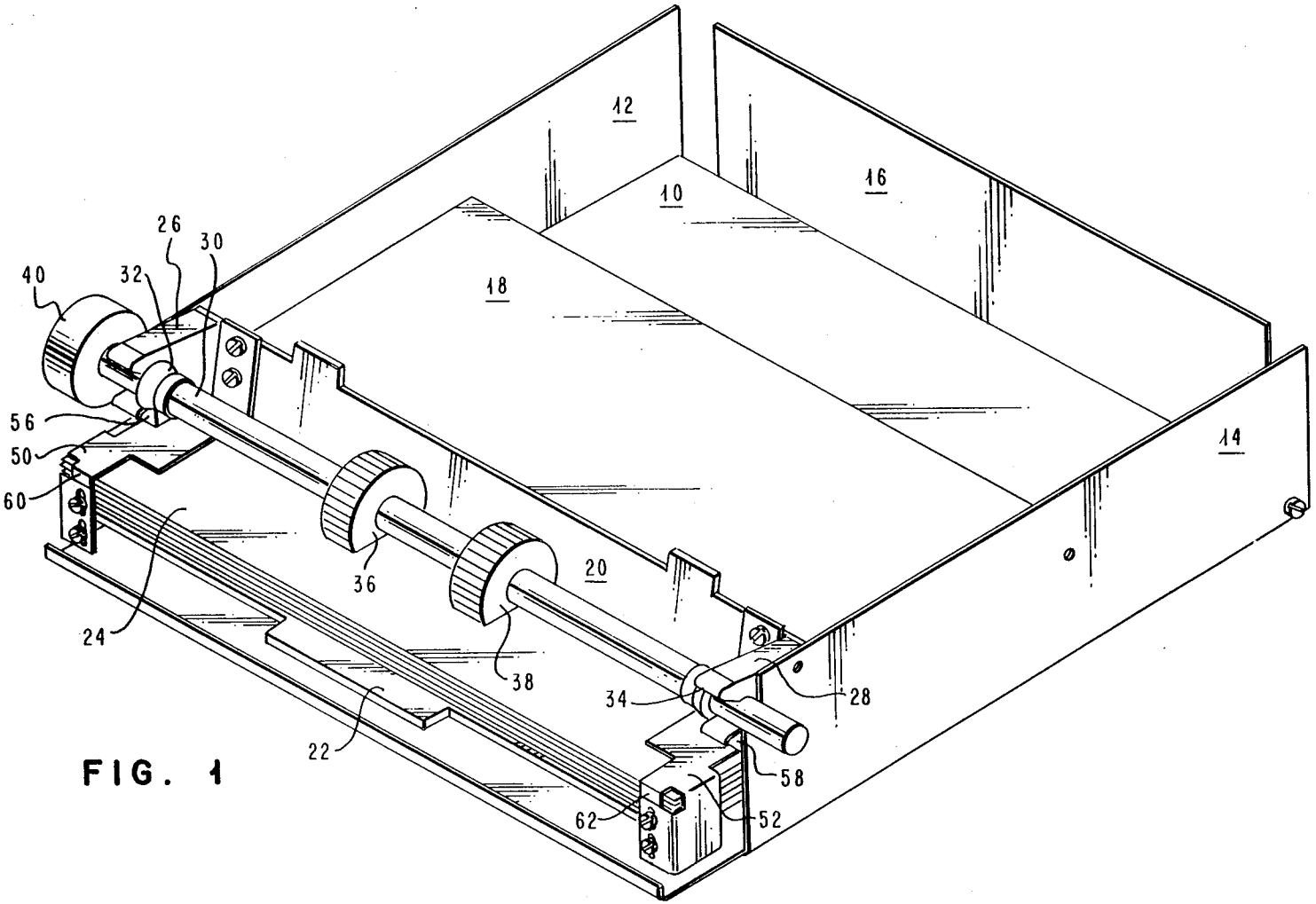
FIG. 1 shows a document hopper provided with the floating throat members of the present invention.

Refer now to FIG. 1. FIG. 1 shows a hopper in which the present invention is embodied. The hopper has a base 10, side walls 12, 14 and rear wall 16. Plate 18 parallel to the base 10 serves to separate the input for fresh envelope storage compartment underneath from the printed or processed envelope storage section above. Cross piece 20 is located between side walls 12 and 14 and is generally parallel to rear wall 16 of the hopper.

There is also provided in the hopper a pivotally, upwardly biased envelope support 22. Stack 24 of envelopes to be processed rests on support 22. Gripper end pieces 26 and 28 are provided on side walls 12 and 14, respectively, for engagingly connecting to shaft 30 around bearings 32 and 34, respectively. D-shaped rollers 36 and 38 are fixedly attached to shaft 30 for rotation therewith. The shaft is not part of the hopper. Rather, it is part of the printer or other using device. Gear 40 is indicated for illustration purposes only as a means for drivingly connecting shaft 30 to the indexing mechanism of the printer.

Floating throat structures 50 and 52 are connected to hopper cross piece 20. Throat members 50 and 52 are leaf springs biased downwardly against the upward movement of envelope support plate 22 as will become clear as the description progresses. Upstop members 56 and 58 are provided beneath shaft grippers 26 and 28. The floating throat members 50 and 52 fulfill the corner restraint function and include adjustable clearance throats 60 and 62 for allowing a single envelope to pass therethrough.

Figure 2:
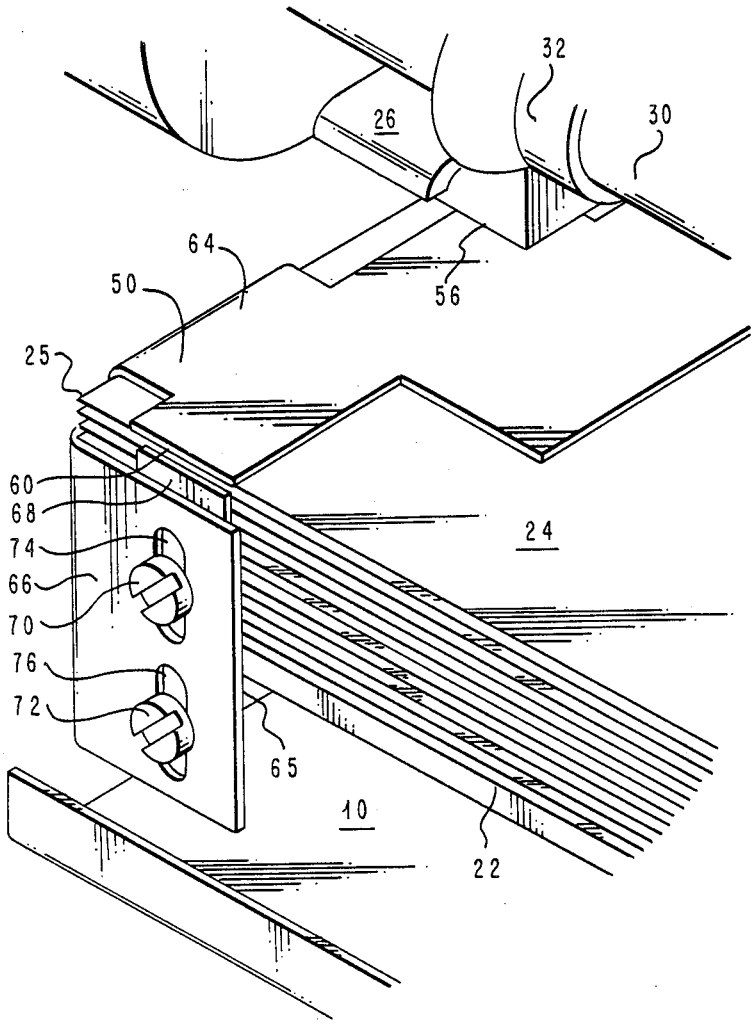
FIG. 2 is an enlarged detail of throat member 50 from FIG. 1.

FIG. 2 is a close-up view of floating throat member 50 in contact with the uppermost envelope 25. Floating throat members 50 and 52 are substantial mirror images of each other so that the description of member 50 applies to both accordingly. Throat member 50 is comprised of two pieces. The leaf spring is attached to cross piece 20 (not shown in this view). It extends parallel to the top of the stack in area 64 and has a side section 65 and a vertical front section 66. Knife edge 68 is slidably attached to vertical section 66 of floating throat member 50. Screws 70 and 72 pass through holes 74 and 76, respectively, for locking knife edge 68 in position for providing a clearance throat 60 formed between the horizontal leaf spring section 64 of members 50 and the knife edge 68.

Figure 3:
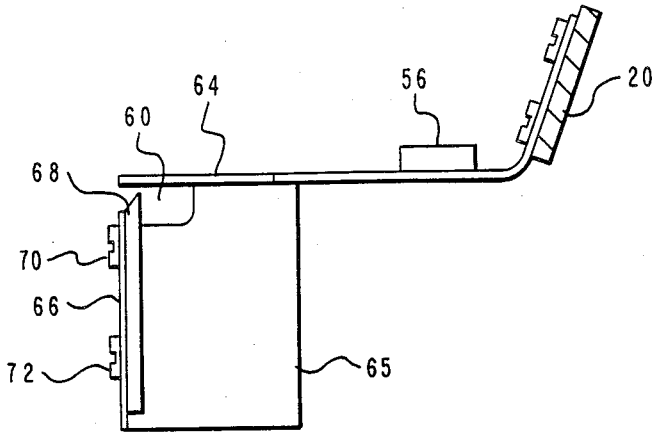
FIG. 3 shows in cross section a throat member in its unbiased position.

Referring now to FIG. 3, the vertical side wall section 65 of floating throat member 50 can be more clearly seen. In FIG. 3 there is a clearance between upstop member 56 and horizontal section 64 of floating throat member 50. It can be seen that leaf spring elements of floating throat member 50 are biased downwardly; however, the upwardly biased envelope support 22 pushes the stack of envelopes 24 against members 50 and 52. In this way the floating throat members serve to limit possible stack height since upstops 56 and 58 limit the upward movement possible for floating throat members 50 and 52.

Figure 4:
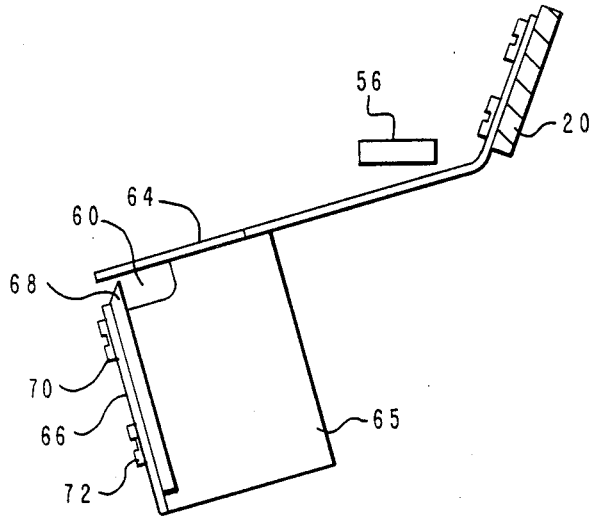
FIG. 4 shows the structural elements of FIG. 3 in their uppermost position.

Similarly, in FIG. 4 the floating throat member 50 is shown in its uppermost position. Because of the cooperating oppositely directed biasing forces of stack support 22 and floating throat members 50 and 52, the horizontal portions of the leaf spring, as illustrated at 64, are urged into contact with the uppermost envelope in the stack even as the stack is depleted.

Thus, in operation, referring again to FIG. 1, when the appropriate signal from the printer causes shaft 30 to rotate, D rings 36 and 38 rotate therewith bringing their rounded portions into contact with the uppermost envelope for urging it and the entire stack downward against the force biasing support plate 22 upward. However, the leaf spring biasing force in floating throat members 50 and 52 keep them in contact with the uppermost envelope so that the actual throat clearances 60 and 62 maintain alignment with the uppermost envelope 25, as shown in FIG. 2.

While the invention has been shown and described having reference to a particular preferred embodiment, various changes in form and detail may be made, as is well understood by those skilled in the art, without departing from the spirit and scope of the invention.

We claim:

1. Apparatus for providing envelopes one at a time in a reliable manner to a device requiring such envelopes comprising:

a base;

side frame members attached to the base;

a support plate for supporting documents, said support plate being biased away from the base;

a cross piece connected between the side frame members;

leaf spring throat members attached to the cross piece and positioned to form corner restraint means with the support plate;

said throat members being biased in the direction opposite to that of the support plate, whereby contact with friction feed means of documents supported on the support plate lowers the support plate against the upwardly biased force and permits the throat members to revert to their downward bias for maintaining the throat in alignment with the uppermost document in the stack.

2. The apparatus of claim 1 wherein the throat members comprise:

horizontal sections;

vertical sections; and the distance between the vertical and horizontal sections is adjustable to correspond to the thickness of the envelope to be fed therethrough.

3. The apparatus of claim 2 wherein the vertical section includes a slidably connected, selectively positionable edge means for adjusting the distance.

* * * * *